US010885889B2

(12) United States Patent
Broome

(10) Patent No.: US 10,885,889 B2
(45) Date of Patent: Jan. 5, 2021

(54) METHOD AND APPARATUS FOR COUNTERBALANCING AN INSTRUMENT

(71) Applicant: Jaige-Anna Trudel Broome, Stanstead (CA)

(72) Inventor: Jaige-Anna Trudel Broome, Stanstead (CA)

( * ) Notice: Subject to any disclaimer, the term of this patent is extended or adjusted under 35 U.S.C. 154(b) by 0 days.

(21) Appl. No.: 16/736,699

(22) Filed: Jan. 7, 2020

(65) Prior Publication Data

US 2020/0219470 A1 Jul. 9, 2020

Related U.S. Application Data

(60) Provisional application No. 62/789,459, filed on Jan. 7, 2019.

(51) Int. Cl.
*G10G 5/00* (2006.01)

(52) U.S. Cl.
CPC ..... *G10G 5/005* (2013.01)

(58) Field of Classification Search
None
See application file for complete search history.

(56) References Cited

U.S. PATENT DOCUMENTS 413,807 A * 10/1889 Loeser et al. ..... G10D 3/18 84/281
451,744 A * 5/1891 Albert ..... G10D 3/18 84/278
491,372 A * 2/1893 Narberti ..... G10D 3/18 84/280
925,481 A * 6/1909 Johns ..... G10D 3/18 84/280
950,873 A * 3/1910 Smith ..... G10D 3/18 84/280
1,199,685 A * 9/1916 Gaylor ..... G10D 3/18 84/280
1,315,015 A * 9/1919 Doyle ..... G10D 3/18 84/278
1,337,459 A * 4/1920 Lappalainen ..... G10D 3/18 84/280
1,431,007 A * 10/1922 Kenne ..... G10D 3/18 84/278
1,895,749 A * 1/1933 Bishop ..... G10D 3/18 84/279
2,061,464 A * 11/1936 Heimers ..... G10D 3/18 84/280
2,273,136 A * 2/1942 Orech ..... F16G 11/046 224/258
2,576,018 A * 11/1951 Johnson ..... G10D 3/18 84/280
2,902,895 A * 9/1959 Sokolik ..... G10D 3/18 84/280
3,136,197 A * 6/1964 Bried ..... G10D 3/18 84/280

(Continued)

*Primary Examiner* — Robert W Horn
(74) *Attorney, Agent, or Firm* — Scheinberg & Associates, PC; Michael O. Scheinberg

(57) ABSTRACT

An apparatus and method for counterbalancing an instrument, such as a violin, is described. The apparatus includes a curved, flexible balancing section comprises a series of pockets into which weights can be placed. The curve causes the weights to tend to be positioned toward the center of the user's back, stabilizing the apparatus.

17 Claims, 8 Drawing Sheets

(56) References Cited

U.S. PATENT DOCUMENTS 4,389,916 A * 6/1983 Ruthstrom ..... G10D 3/18 84/278
4,765,219 A * 8/1988 Alm ..... G10D 1/02 224/910
4,913,027 A * 4/1990 Twohy ..... G10D 3/18 84/280
5,780,756 A * 7/1998 Babb ..... G10D 3/18 84/280
6,250,525 B1 * 6/2001 Lehoux ..... G10G 5/005 224/257
6,796,468 B1 * 9/2004 Nideborn ..... A45F 5/00 224/201
7,009,097 B1 * 3/2006 Terplivetz ..... G10G 5/005 84/327
7,235,731 B2 * 6/2007 Poff ..... G10G 5/005 84/274
7,544,871 B2 * 6/2009 Ringeride ..... G10G 5/005 84/280
8,237,036 B2 * 8/2012 Naylor ..... G10G 5/005 84/327
9,190,041 B1 * 11/2015 Miller ..... G10G 5/005
9,530,394 B1 * 12/2016 Corcorran ..... G10D 3/173
9,659,551 B1 * 5/2017 Rubin ..... G10G 5/005
9,812,102 B2 * 11/2017 de Chadenedes ..... G10G 5/005
9,978,351 B1 * 5/2018 Krishnamachari .... G10G 5/005
2005/0183564 A1 * 8/2005 Ripley ..... G10D 3/18 84/327
2006/0011688 A1 * 1/2006 Duncan ..... B60R 11/02 224/602
2007/0099774 A1 * 5/2007 Bruback ..... A63B 21/0602 482/105
2011/0203441 A1 * 8/2011 Naylor ..... G10G 5/005 84/327
2013/0152766 A1 * 6/2013 Perrault ..... G10G 5/005 84/453
2020/0219470 A1 * 7/2020 Broome ..... G10G 5/005

* cited by examiner

METHOD AND APPARATUS FOR COUNTERBALANCING AN INSTRUMENT

TECHNICAL FIELD OF THE INVENTION

The present invention relates to an apparatus for counterbalancing a violin or viola that enables improved playing conditions during practice and performance of said instrument.

BACKGROUND OF THE INVENTION

In order to play, fiddlers and violinists need to secure the violin on the left shoulder; conventionally, a musician will grip the instrument between the shoulder and the chin. This frequently results in the musician over-tensing in the neck and shoulder muscles, which can lead to chronic pain and other symptoms. Excessive tension is also generally considered detrimental to performance ability.

Various solutions to this generally recognized problem have been proposed.

One solution is an invention is known as the Violin Valet, which is commercially available at http://www.violinvalet.com. The Violin Valet comprises a harness, affixed to the instrument itself, and a counterweight, which is affixed to said harness and hung over the shoulder, counterbalancing the weight of the instrument. The Violin Valet relieves the player of having to grip the instrument between the chin and the shoulder in order to secure it.

However, the Violin Valet still has several problems. First, it requires the use of a shoulder rest, which adds extra weight to be borne by the musician. Second, it is difficult to fit to a particular musician's physiological makeup, which can result in a musician contorting him or herself to adjust to the shoulder rest, which is not conducive to optimal playing. Third, the counterbalancing weight is not adjustable. This is problematic because different musicians prefer different dynamic balancings and positionings of the instrument for different styles of music and playing. Fourth, the weight of the counterbalance is a single, unitary weight that is not distributed evenly or comfortably, which can distract from optimal playing performance and can swing back and forth, distracting the musician and encouraging the performer to adopt a rigid, unmoving posture so as to avoid swinging of the weight.

Another approach is known as the Balanced Shoulder Rest, which is commercially available at https://thinknsn.com. The Balanced Shoulder Rest comprises a curved, shape-adjustable rigid bar having two ends: the violin-side end, to which the instrument is attached, and which curves so as to rest on the left shoulder by wrapping over and around the left shoulder, securing the position of the instrument relative to the player; and a counterweight end, which continues horizontally across the back, offsetting the weight of the instrument and the violin-side end of the rigid bar The Balanced Shoulder Rest has the advantage of fixing the position of the instrument without the musician having to grip it between the chin and shoulder. However, the Balanced Shoulder Rest is bulky and inconvenient to store, carry and transport. Being rigid, it is awkward to adjust and to wear, detracting from optimal performance.

SUMMARY OF THE INVENTION

An object of the invention is to provide an improved instrument counterweight.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Described below is an apparatus for counterbalancing an instrument, such as a violin or viola. The invention also includes a method of counterbalancing an instrument. The counterbalancing apparatus is referred to as a "fiddle anchor," although the invention is not limited to counterbalancing a fiddle. The counterbalancing apparatus includes a connector such as a hook for attachment to the instrument, a tapered portion which disperses the load of the counterbalance horizontally, and a flexible balance comprising a curved flexible balancing section which contains the weights for counter-balancing the instrument.

The curved flexible balancing section preferably comprises a series of overlapping pockets, into each of which a variable weight can be placed. The curved flexible balancing section is curved so as to distribute the weight of the fiddle anchor down across the back of the musician. The curve of the fiddle anchor makes the weight tend towards the center of the back, making the device more centered on the player's back, preventing the fiddle anchor from slipping over the player's left shoulder blade and making the fiddle anchor less prone to swinging when the musician moves during playing.

Figure 1:
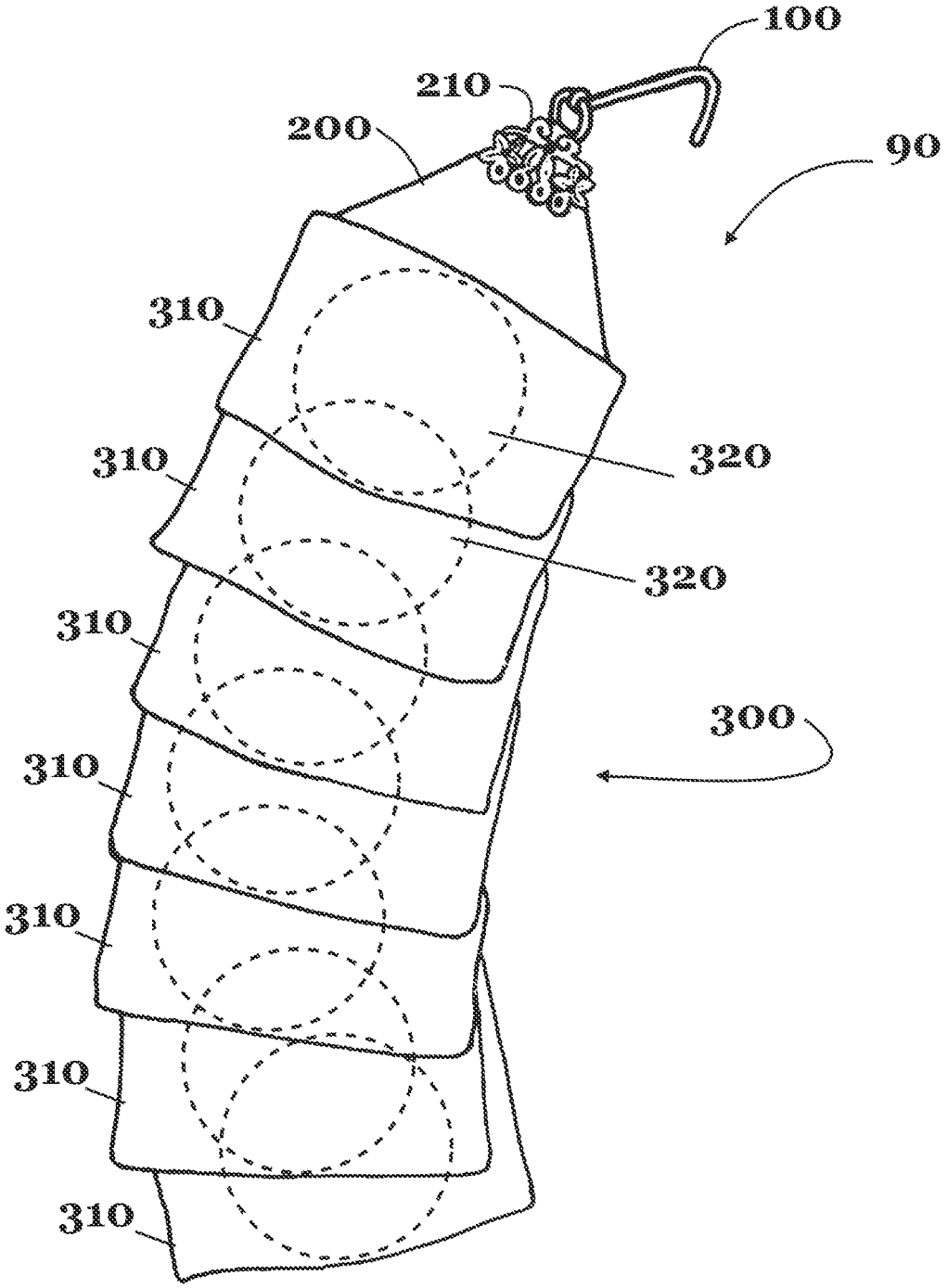
FIG. 1 shows a fiddle anchor.

One embodiment is shown in FIG. 1, which shows the fiddle anchor 90 provided with a connector 100 such as a hook for attachment of the fiddle anchor to the instrument. Any type of connector, such as open hooks, spring closure hooks, screw closure connectors, clip on connectors, or other connector type can be used. Fiddle anchor 90 also includes a tapered portion 200 which is triangular and made of a supple material. Tapered portion 200 spreads the support from the hook, essentially a single point of attachment, to the broader, weight bearing portions of the fiddle anchor 90. A rigid or semirigid component 210, positioned on the tapered portion near the connector 100 helps to disperse the load of the counterbalance horizontally. The rigid or semi-rigid component 210 can be made of metal and can be ornamental, or can be made of any material and may be on the side of the tapered potion 200 that is exposed during use, or can be within tapered portion 200 or on the side of tapered potion 200 that is hidden from view during use.

A curved flexible balancing section 300, connected to the tapered portion 200 is made up of individual pockets 310, each of which can contain a weight 320 for counterbalancing the instrument. Weights 320 are shown in dashed lines because they are within pockets 310 and not visible from outside the fiddle anchor. Weights 320 can be any shape, such as round, elliptical, or rectangular. The edges of weight 320 can be rounded to reduce potential damage to the interior of the pockets. Weights 320 may be padded with soft, sound-damping material, such as felt, foam, or something else.

The weights can be removeable from the pockets, or the weights can be permanently attached, such as by being sewn into the pockets. For removeable weights, the pockets can have open tops or can have closure, such as snaps, buttons, Velcro, or zippers. Alternatively, a trifold pocket design, such as is known from home-made pillows covers, can be used to secure the weight into place without requiring any fastener. In some embodiments, the weights could include a hole providing additional ways to secure the weight. For example, fabric on both sides of the weight could include parts of a two-part snap connector, such that the snap closes through the hole in the weight, thereby securing the weight.

The flexible balance has two long sides and a longitudinal axis half way between the two long sides, the longitudinal axis forming a curve. The pockets are spaced longitudinally along the flexible support, the pockets configured to receive counterweights that balance the weight of the instrument.

Figure 2:
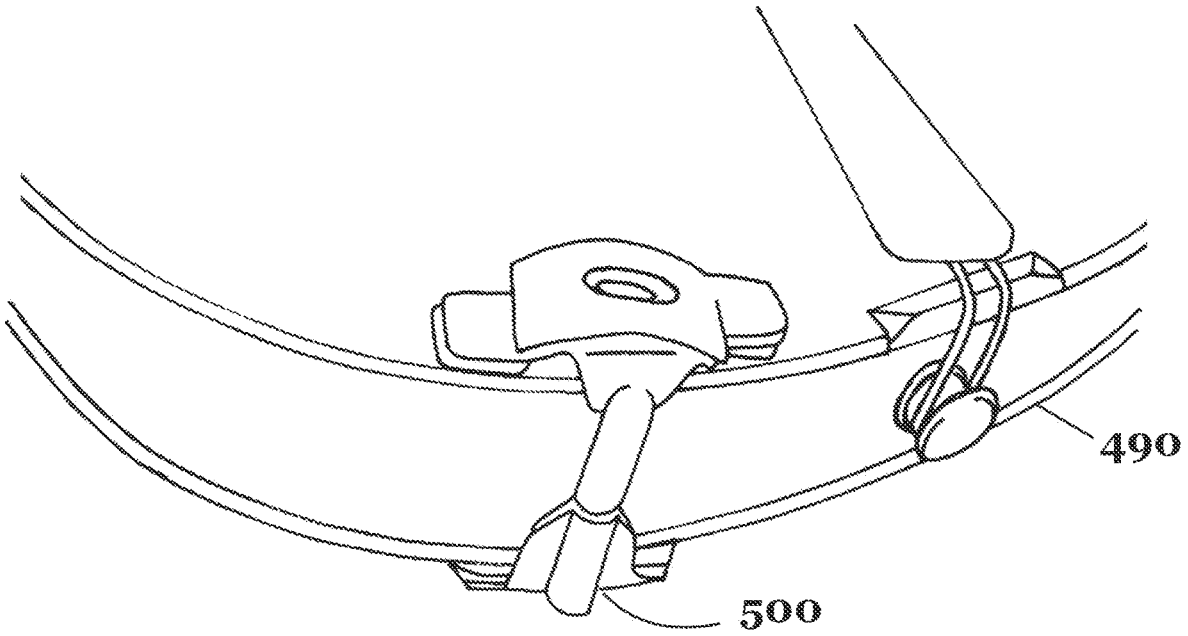
FIG. 2 shows an instrument with a clamp attached, the clamp providing an attachment point for the fiddle anchor of FIG. 1

FIG. 2 shows a clamp 500, to which connector 100 can be connected, attached an instrument, a violin 490. Another advantage of using a clamp is that the clamp, and thus the fiddle anchor, can be attached to any point on the lower bout of the instrument, allowing for different positions of the instrument to accommodate different players and different styles of music. Alternatively, the fiddle anchor can attach to the chin rest clamp in some cases, although that limits the range of positions that can be used as the anchor point. Clamp 500 can be moved anywhere along the lower bout of the violin so as to provide the most balanced point of connection.

Figure 3:
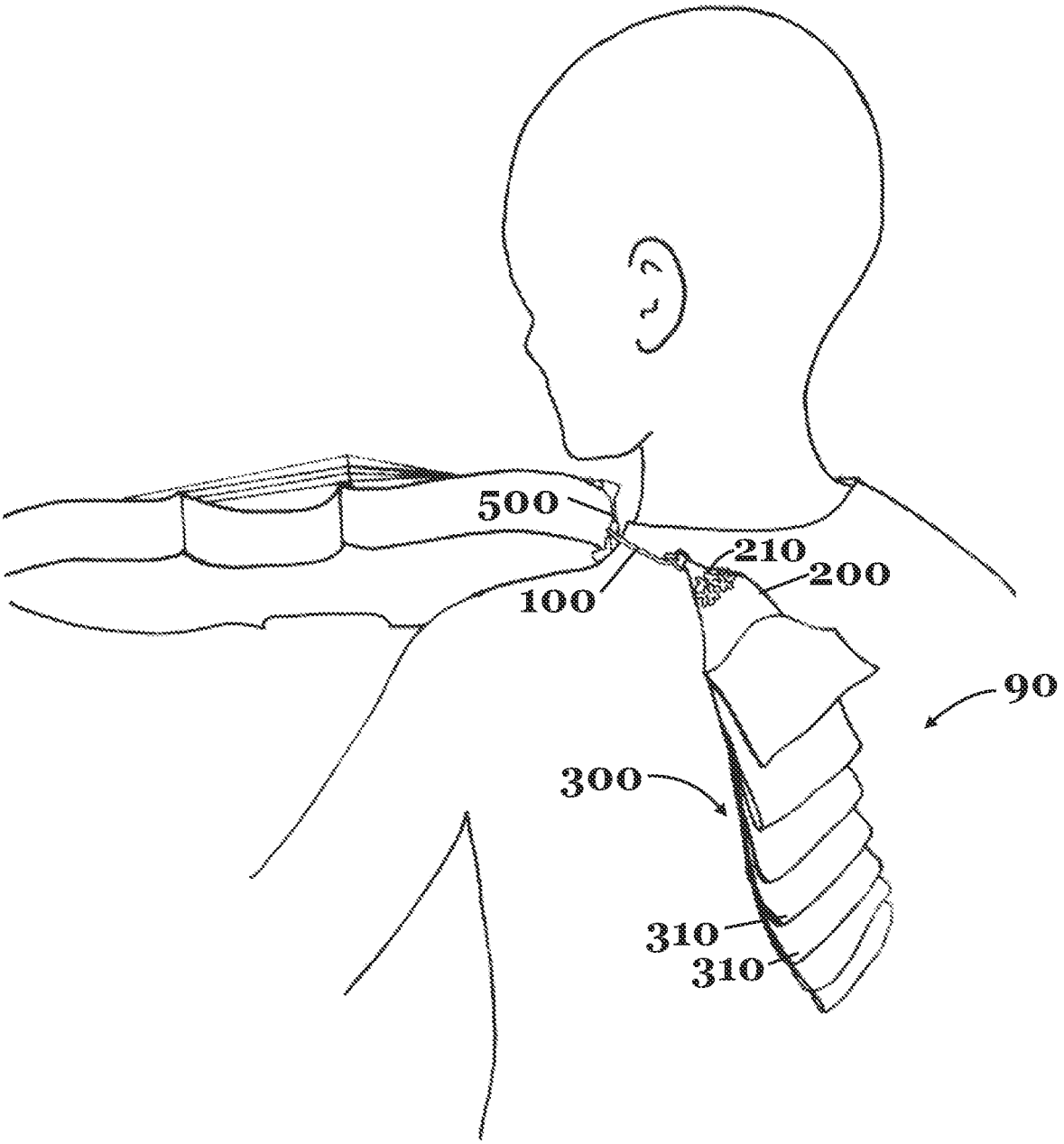
FIG. 3 shows the fiddle anchor of FIG. 1 in use.

FIG. 3 shows fiddle anchor 90 in use. Curved flexible balancing section 300 is positioned on the user's back and fiddle anchor 90 is attached to violin 490 via connector 100. Note that curved flexible balancing section 300 curves from the side of the user's back where fiddle anchor is connected to the instrument toward the center of the user's back.

Figure 4:
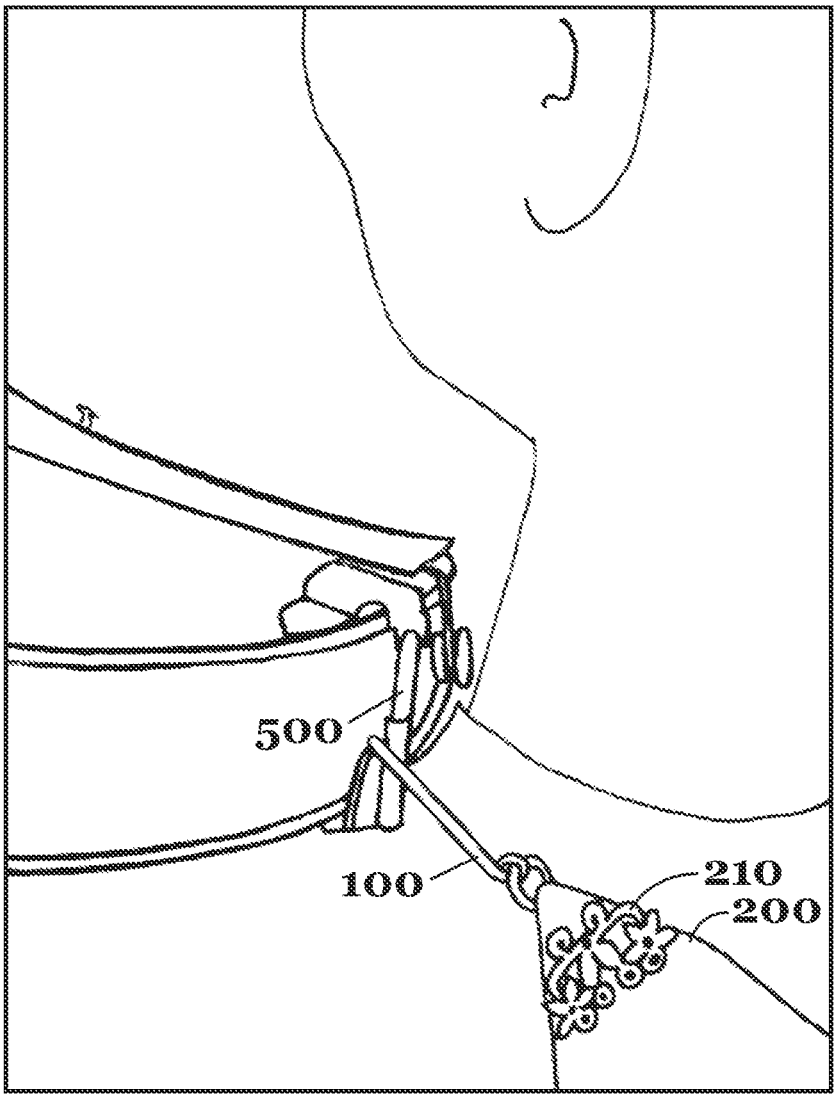
FIG. 4 is an enlarge view showing a portion of the fiddle anchor of FIG. 1 in use.

FIG. 4 shows the portion of the fiddle anchor 90 where it is attached to the violin 490 when in use. Connector 100 is attached clamp 500 on violin 490. The fiddle anchor can be used in conjunction with a chinrest and/or shoulder rest, or can be used without a chinrest or shoulder rest.

In some embodiments, the weights added into each pocket can be adjusted. For example, weights between 20 grams and 100 grams could be added to each of the pockets 310, as needed and depending on individual preference.

In some embodiments, additional pockets can be attached to fiddle anchor to lengthen the curved weighted section 300, making it possible to adjust weight in this manner and to change the geometry of the fiddle anchor, as per individual preference to optimize the wearability and comfort while playing. Curved weighted section 300 may be constructed by sewing multiple pockets together, each pocket offset longitudinally from the previous pocket to extend the length of the curved weighted section 300 and offset transversely to curve the curved weighted section 300 toward the center of the user's back. Alternatively, the pockets themselves may be formed by folding and sewing a single piece of material. In other embodiments, curved weighted section 300 may be composed of a backing material that extends the length of the curved weighted section 300, with pockets attached to the piece of backing material. Also, various combinations of the fabrication methods described above can also be used.

Figure 5:
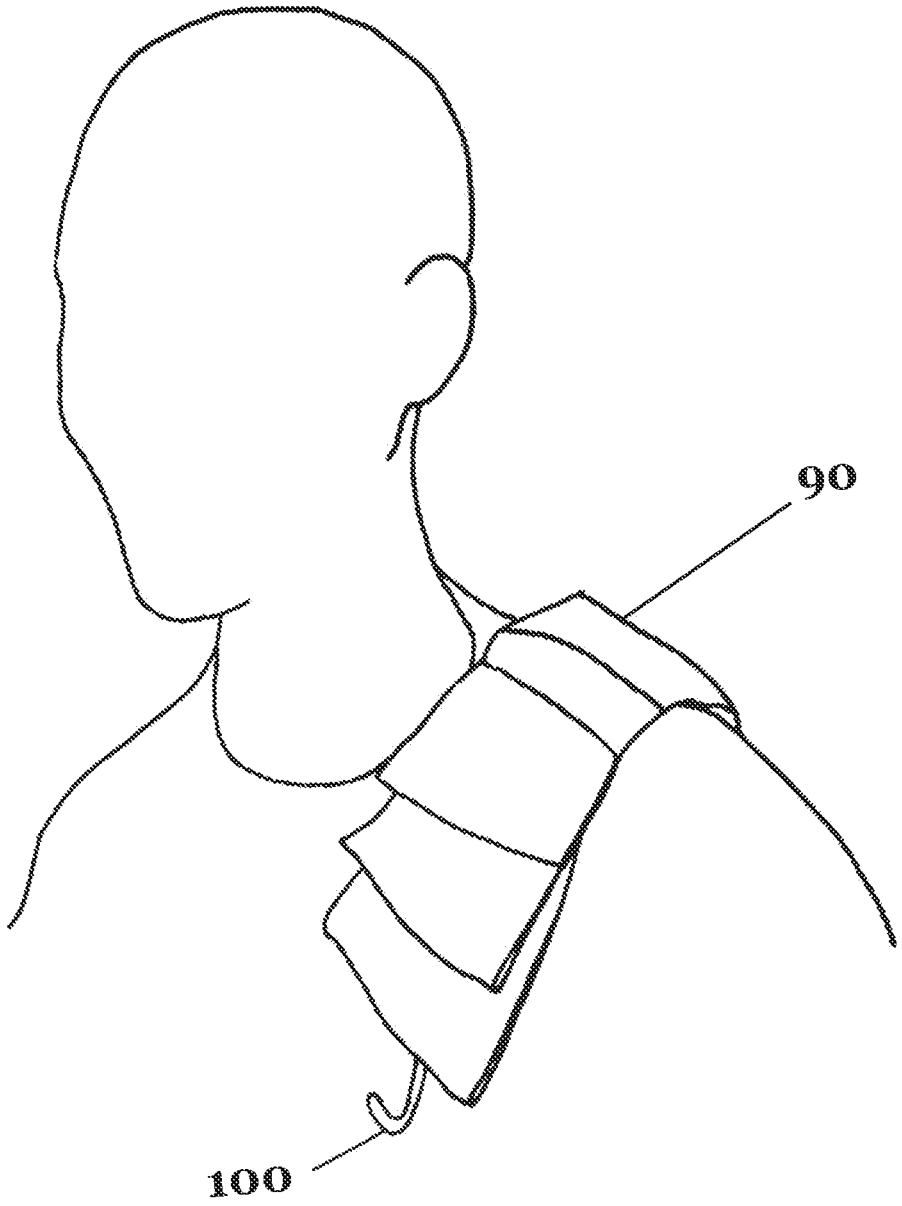
FIG. 5 shows the fiddle anchor of FIG. 1 resting on the shoulder of a musician when the fiddle anchor is not in use and the instrument is not being played.

In some embodiments, the pockets are attached at one edge to the curved weighted section 300 so that the pockets can be flipped forwards or backwards relative to the main body of the curved weighted section 300. In this way, when not playing, the musician can flip a portion of the pockets forwards so that the fiddle anchor can be balanced on the shoulder when not attached to an instrument, as illustrated in FIG. 5.

Figure 6:
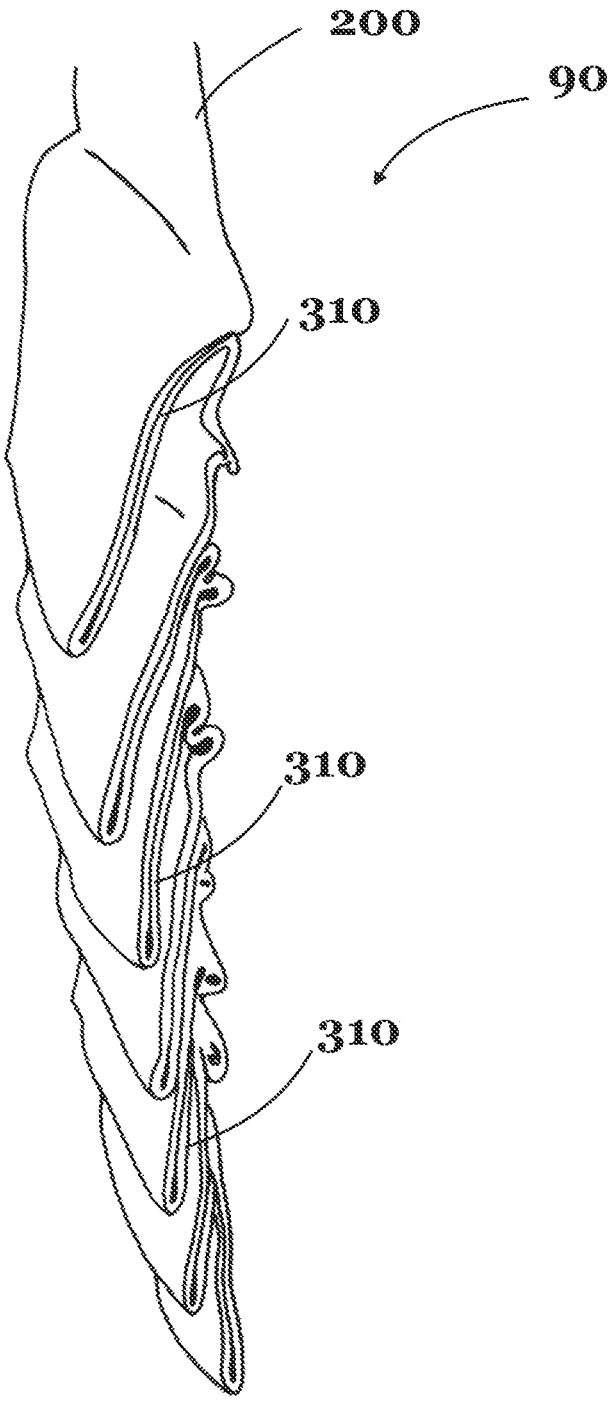
FIGS. 6, 7, and 8 show additional views of the fiddle anchor of FIG. 1.
Figure 7:
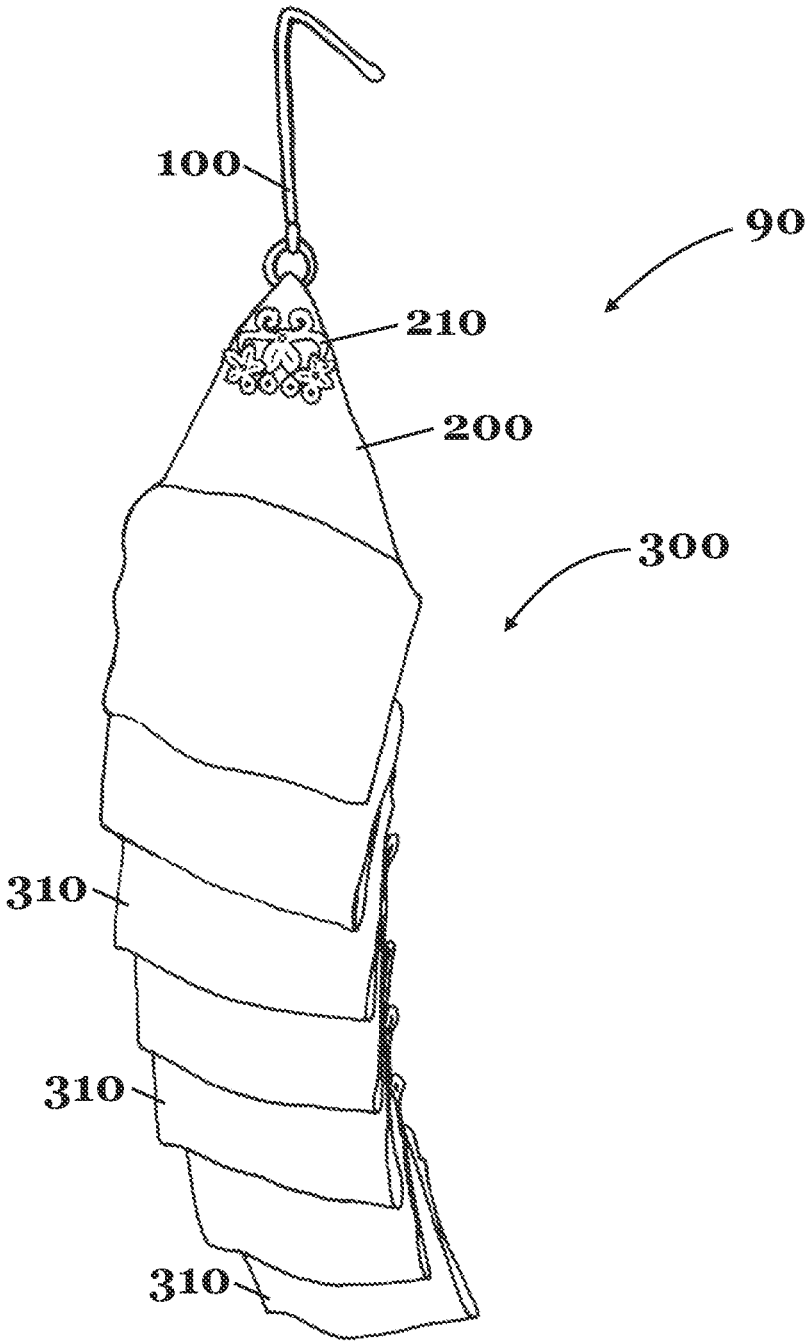
Figure 8:
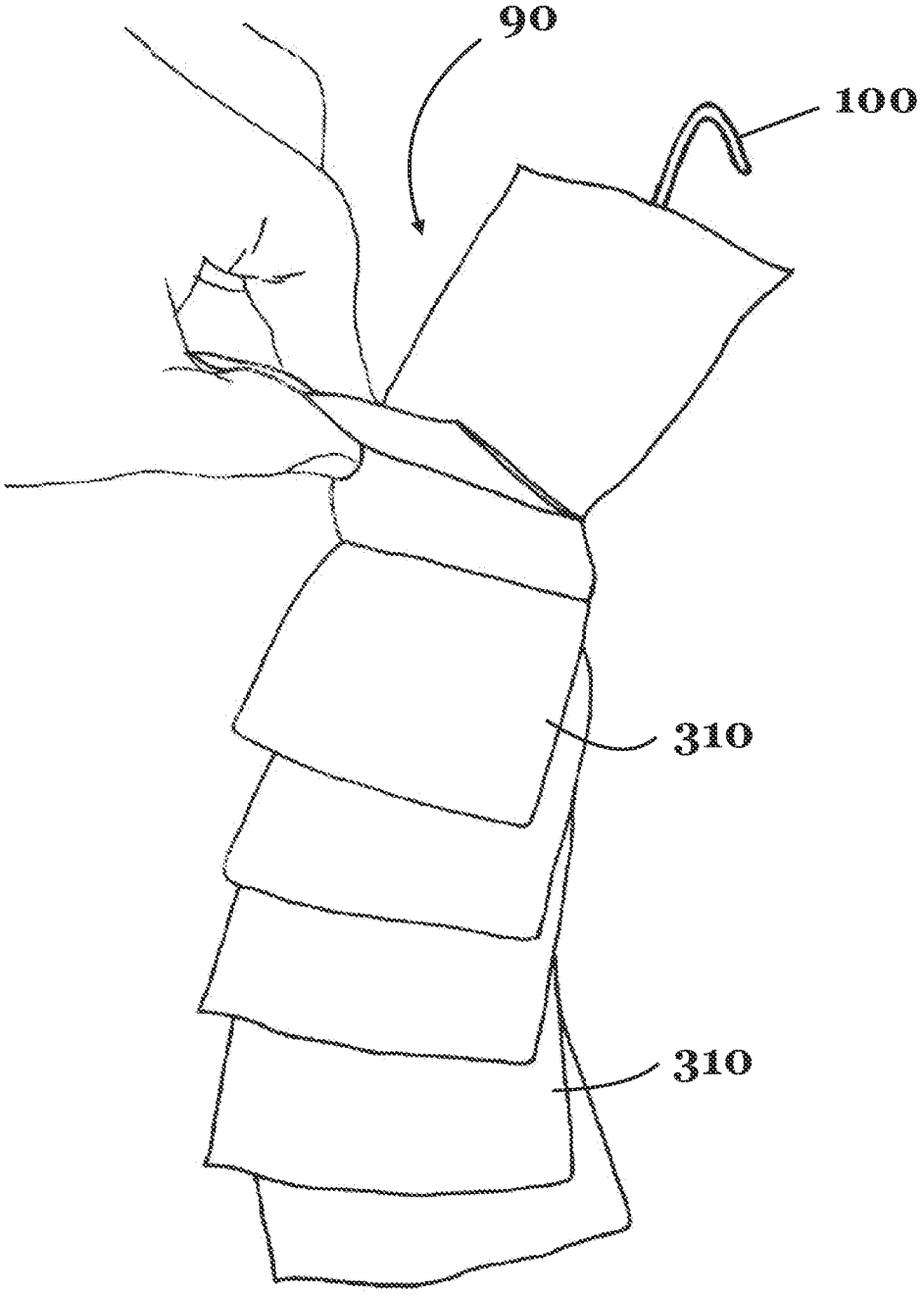

In some embodiments, the weight pockets overlap each other, which allows making the pocket size big enough to easily change the weights in each pocket. FIGS. 6, 7, and 8 show the how the fiddle anchor 290 is composed of a series of connected pockets. Overlapping pockets allow keeping the fiddle anchor at a manageable and convenient length that still allows a curve towards the center of the back, making the device more centered on the player's back, preventing the fiddle anchor from slipping over the player's left shoulder blade and making the fiddle anchor less prone to swinging when the musician moves during playing. It also allows for more aesthetic designs suitable for performance.

The tapered portion 200 and the curved weighted section 300 are preferably made of a supple material such as leather or cloth to allow for simple adjustment of the shape of the fiddle anchor to the shape of the individual musician's back. The curve of the fiddle anchor falls naturally across the musician's back, making tedious or difficult adjustment of components unnecessary.

The weight of the fiddle anchor as a whole can range from 50% to 120% of the weight of the instrument being counterbalanced. The amount of the overall curve of the fiddle anchor is preferably between 25 and 50 degrees; the purpose of the curve is to prevent slippage and to distribute the weight of the fiddle anchor towards the center of the musician's back.

The method of counterbalancing an instrument comprises providing a fiddle anchor as described above, attaching the fiddle anchor to the instrument, and positioning the instrument in a playing position. The method can also include positioning a chin rest and/or a shoulder rest. The method can also include inserting weights into one or more pockets of the fiddle anchor and positioning the fiddle anchor along the user's back, with the fiddle anchor curving toward the center of the wearer's back. The method of counterbalancing can include adjusting the overall weight of the fiddle anchor and/or adjusting the distribution of weights in the pockets of the fiddle anchor.

A preferred method or apparatus of the present invention has many novel aspects, and because the invention can be embodied in different methods or apparatuses for different purposes, not every aspect need be present in every embodiment. Moreover, many of the aspects of the described embodiments may be separately patentable. The invention has broad applicability and can provide many benefits as described and shown in the examples above. The embodiments will vary greatly depending upon the specific application, and not every embodiment will provide all of the benefits and meet all of the objectives that are achievable by the invention.

In the following discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning. The accompanying drawings are intended to aid in understanding the present invention and, unless otherwise indicated, are not drawn to scale.

The various features described herein may be used in any functional combination or sub-combination, and not merely those combinations described in the embodiments herein. As such, this disclosure should be interpreted as providing written description of any such combination or sub-combination.

Although the present invention and its advantages have been described in detail, it should be understood that various changes, substitutions and alterations can be made to the embodiments described herein without departing from the scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. An apparatus for balancing an instrument while playing, comprising:

a flexible balance;

a clamp for attaching the flexible balance to the instrument;

the flexible balance constructed using multiple, partially overlapping pockets;

multiple weights positioned in the multiple overlapping pockets, such that the weights overlap;

the flexible material supporting the weights such that a line through the center of each weight forms a curve such that the weights positioned further from the clamp are positioned closer to the wearer's spine.

2. The apparatus of claim 1 in which the weights are removable from the pockets.

3. The apparatus of claim 1 in which the weights are not removable from the pockets.

4. An apparatus for balancing an instrument while playing, comprising:

a flexible balance having two long sides and a longitudinal axis half way between the two long sides, the longitudinal axis forming a curve;

a connector at one end of the flexible balance, the connector configured to connect to the instrument;

multiple pockets spaced longitudinally along the flexible balance, the pockets configured to receive counterweights that balance the weight of the instrument;

at least one counterweight positioned in at least one of the multiple pockets, the curve of the longitudinal axis allowing the instrument to be balanced on one shoulder of the musician while the flexible balance extends towards the central axis of the wearer's back.

5. The apparatus of claim 4 in which the multiple pockets are spaced longitudinally along the flexible balance.

6. The apparatus of claim 4 in which the at least one counterweight positioned in at least one of the multiple pockets comprises multiple counterweights, at least one counterweight positioned in more than half of the multiple pockets.

7. The apparatus of claim 4 in which the flexible balance comprises multiple segments sewn together.

8. The apparatus of claim 4 in which the shapes of the counterweights are round.

9. The apparatus of claim 4 in which the multiple weights are positioned along at least 50 percent of the flexible balance.

10. The apparatus of claim 4 further comprising a clamp for clamping onto the instrument and attaching to the connector.

11. The apparatus of claim 4 in which the multiple pockets overlap each other.

12. The apparatus of claim 11 in which the weights in the multiple pockets overlap each other.

13. The apparatus of claim 4 in which the multiple pockets a wearer can inert additional weights into the pockets, remove weights from the pockets, or rearrange weights among the pockets.

14. An apparatus for assisting a musician in the support of an instrument, comprising:

a counterweight balance having a connection end and a distal end;

a connector configured for attaching to the instrument and positioned at the connecting end of the counterweight balance;

multiple pockets positioned along the counterweight balance; and one or more counterweights positioned in one or more of the multiple pockets, the multiple pockets configured to extend down a user's back.

15. The apparatus of claim 14 in which the counterweights are removable from the pockets to allow the wearer to reposition the adjust the total weight balanced by the counterweight balance.

16. The apparatus of claim 14 in which the counterweight balance is fabricated from multiple sections, with more than one of the multiple sections comprising a pocket.

17. The apparatus of claim 14 further comprising a tapered portion between the connector and the counterweight balance.

* * * * *